US007082626B2

(12) United States Patent
Williams et al.

(10) Patent No.: US 7,082,626 B2
(45) Date of Patent: Aug. 1, 2006

(54) DIVERTER ASSEMBLY FOR ROMAN TUB

(75) Inventors: Alston E. Williams, Irvine, CA (US); Scott C. Baker, Lake Forest, CA (US); Indalecio Ortega, Lakewood, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/346,875

(22) Filed: Jan. 17, 2003

(65) Prior Publication Data

US 2004/0139544 A1 Jul. 22, 2004

(51) Int. Cl.
*A47K 3/20* (2006.01)

(52) U.S. Cl. ..... 4/570; 4/567; 4/678; 137/119.05

(58) Field of Classification Search ..... 4/567, 4/568, 570, 615, 678; 137/119.03, 119.05, 137/859, 801, 119.04, 871
See application file for complete search history.

(56) References Cited

U.S. PATENT DOCUMENTS

| | | | | |
|---|---|---|---|---|
| 2,043,668 A | | 6/1936 | Kohler | 137/625.5 |
| 2,968,313 A | | 1/1961 | Camp | 137/467 |
| 3,086,748 A | | 4/1963 | Reinemann | 4/678 X |
| 3,236,253 A | * | 2/1966 | Symmons | 137/119.05 |
| 3,387,816 A | | 6/1968 | Holycross | 4/615 X |
| 3,473,558 A | | 10/1969 | Mongerson | 4/678 X |
| 3,746,031 A | | 7/1973 | Christiansen | 4/678 |
| RE27,819 E | | 11/1973 | Moen | 4/678 X |
| 3,801,997 A | | 4/1974 | Ward | 4/678 X |
| 3,906,983 A | | 9/1975 | Parkison | 137/467 |
| 3,913,605 A | | 10/1975 | Ward | 4/615 X |
| 4,117,858 A | | 10/1978 | Bucknell et al. | 137/467 |
| 4,171,005 A | | 10/1979 | Nicklas | 137/467 |
| 4,606,370 A | | 8/1986 | Geipel et al. | 137/119.05 |
| 4,874,006 A | * | 10/1989 | Iqbal | 137/119.05 |
| 5,025,825 A | * | 6/1991 | Gayton | 4/675 X |
| 5,279,005 A | | 1/1994 | Valley | 4/567 |
| 5,845,670 A | * | 12/1998 | Life | 137/119.05 |
| 6,449,784 B1 | | 9/2002 | Pelletz | 4/675 |

* cited by examiner

*Primary Examiner*—Robert M. Fetsuga
(74) *Attorney, Agent, or Firm*—Harness, Dickey & Pierce, P.L.C.

(57) ABSTRACT

A roman tub faucet with a hand shower diverter mechanism integral to the tub spout. The diverter mechanism is especially suited for applications where service access to only the outer tub finished surface is practical. The faucet eliminates the need to remove panel or tile portions from the tub area for diverter mechanism service or replacement. The faucet also eliminates the need for an additional installation hole that is required for roman tub faucets with a separate diverter mechanism and tub spout.

19 Claims, 5 Drawing Sheets

DIVERTER ASSEMBLY FOR ROMAN TUB

FIELD OF THE INVENTION

The present invention relates generally to roman tub faucets and more specifically to diverter valves that are integral to the tub spout and serviceable from the exterior of the faucet mounting surface.

BACKGROUND OF THE INVENTION

A roman tub faucet is typically mounted on a horizontal surface adjacent a tub. A conventional roman tub faucet with a hand shower utilizes a diverter valve to switch the flow of water between the spout and the hand shower. The diverter valve is typically located below the horizontal mounting surface. Often, an installed roman tub is not provided with an access panel for the faucet components that are below the mounting surface. Maintenance or replacement of a diverter valve installed in this manner requires that panels or tiles in the faucet area are removed.

What is needed is a roman tub faucet with a hand shower that incorporates a diverter valve that is serviceable above the finished horizontal surface.

SUMMARY OF THE INVENTION

The present invention is directed to a roman tub outlet assembly that incorporates a diverter valve for a hand shower. In one preferred form, the present invention provides an outlet assembly that forms a tub spout and houses a diverter valve. The diverter valve is removable from the outlet assembly by a technician who has access to only the finished surface of the tub area. In another aspect, the present invention provides a diverter assembly that is located above the finished surface of the tub area.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
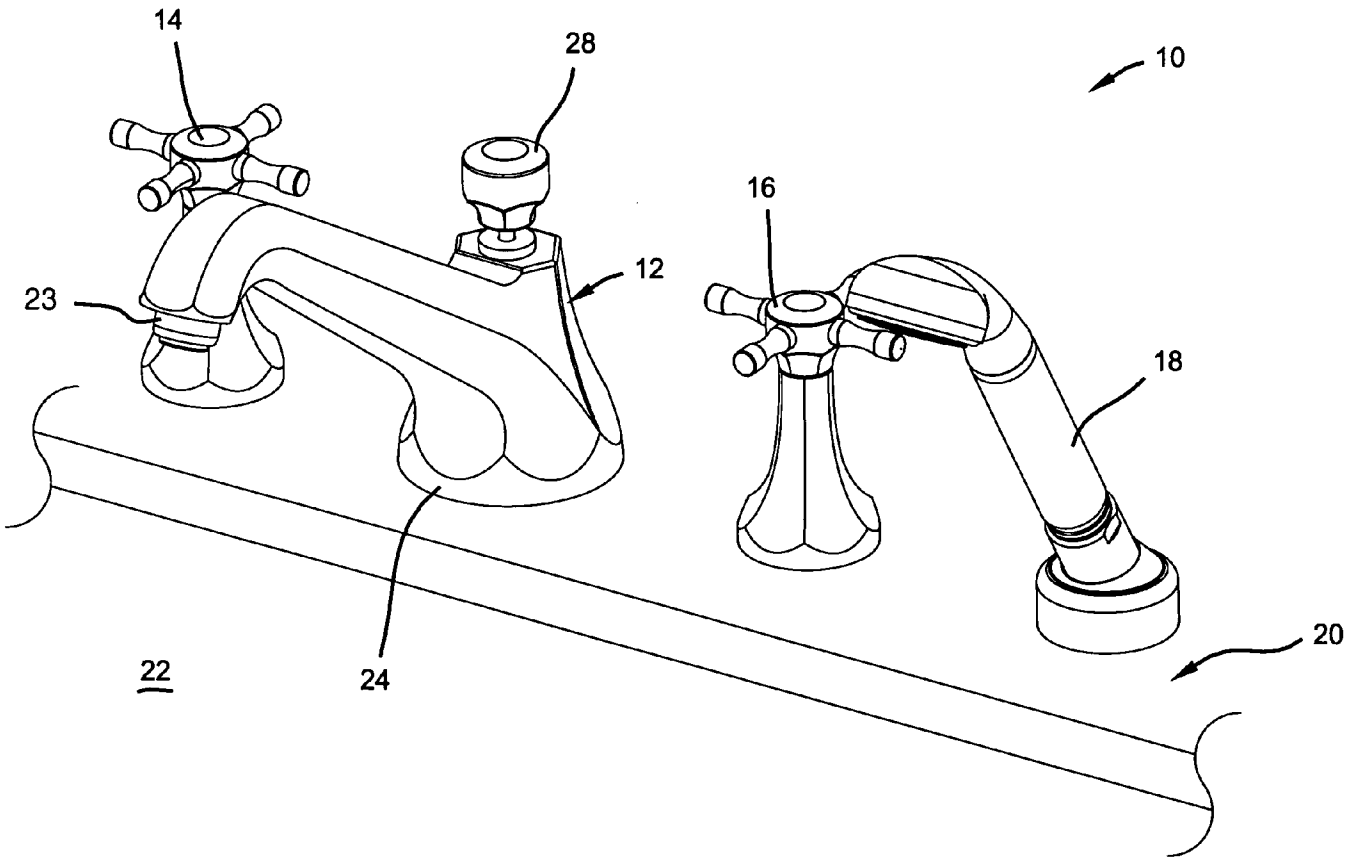
FIG. 1 is a perspective view of an installed roman tub outlet assembly with hand shower incorporating the diverter assembly of the present invention.
Figure 2:
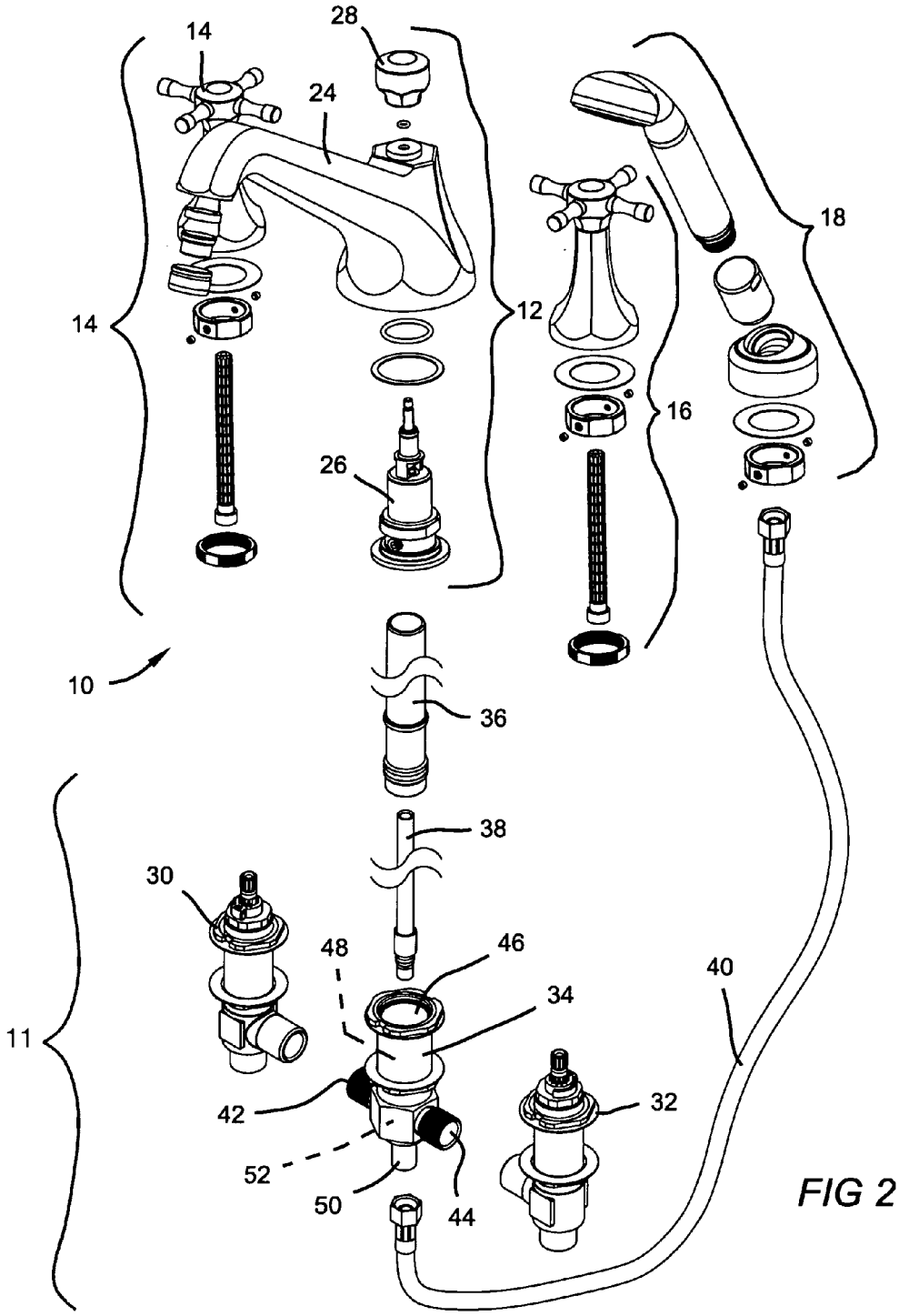
FIG. 2 is an exploded perspective view of the roman tub assembly of FIG. 1 showing components that are located below the finished surface.

With reference to FIGS. 1 and 2, a roman tub faucet is generally indicated by reference numeral 10. Roman tub faucet 10 includes an outlet assembly 12, a hot water valve operator 14, a cold water valve operator 16, and a hand shower 18. Preferably, roman tub faucet 10 is mounted to faucet deck, or a horizontal surface 20, that is adjacent a tub 22. Outlet assembly 12 includes a spout 24 having an interior chamber 25, a spout outlet 23, a diverter assembly 26, and a knob 28. The spout 24 is adapted to be mounted to a finished surface 20 with at least a portion 11 of the faucet 10 extending below the finished surface 20. The primary outlet spout 24 is located above the finished surface 20, and the diverter mechanism 26 is disposed in the spout 24, thus adapted to be serviceable from a location above the finished surface 20. FIG. 2 illustrates components of the roman tub faucet 10 that are located below finished surface 20. A first valve assembly includes a hot water valve 30, a cold water valve 32, a first valve body 34, an inlet or feed tube 36, a secondary outlet tube 38, and a flexible hose 40. Valve body 34 includes a hot water inlet 42, a cold water inlet 44, a mixer outlet 46, a secondary outlet tube connection 48, and a flexible hose connection 50. Secondary outlet tube connection 48, and flexible hose connection 50 are connected by a passageway 52 (as best seen in FIG. 4) that extends through body 34.

When assembled, hot water valve 30 is in fluid communication with a pressurized supply of hot water and hot water inlet 42. Hot water valve operator 14 is coupled to hot water valve 30. Hot water valve 30 is a conventional roman tub valve that adjusts the flow rate of hot water to valve body 34. Cold water valve 32 is in fluid communication with a pressurized supply of cold water and cold water inlet 44. Cold water valve operator 16 is coupled to cold water valve 32. Cold water valve 32 is a conventional roman tub valve that adjusts the flow rate of cold water to body 34. Inlet tube 36 is attached to mixer outlet 46. Secondary outlet tube 38 is coupled to secondary outlet tube connection 48, and flexible hose 40 is coupled to flexible hose connection 50 such that passageway 52 is in fluid communication with both secondary outlet tube 38, and flexible hose 40. Preferably, secondary outlet tube 38 extends concentrically through inlet tube 36. Flexible hose 40 is connected to hand shower 18 such that secondary outlet tube 38 is in fluid communication with flexible hose 40.

Figure 3:
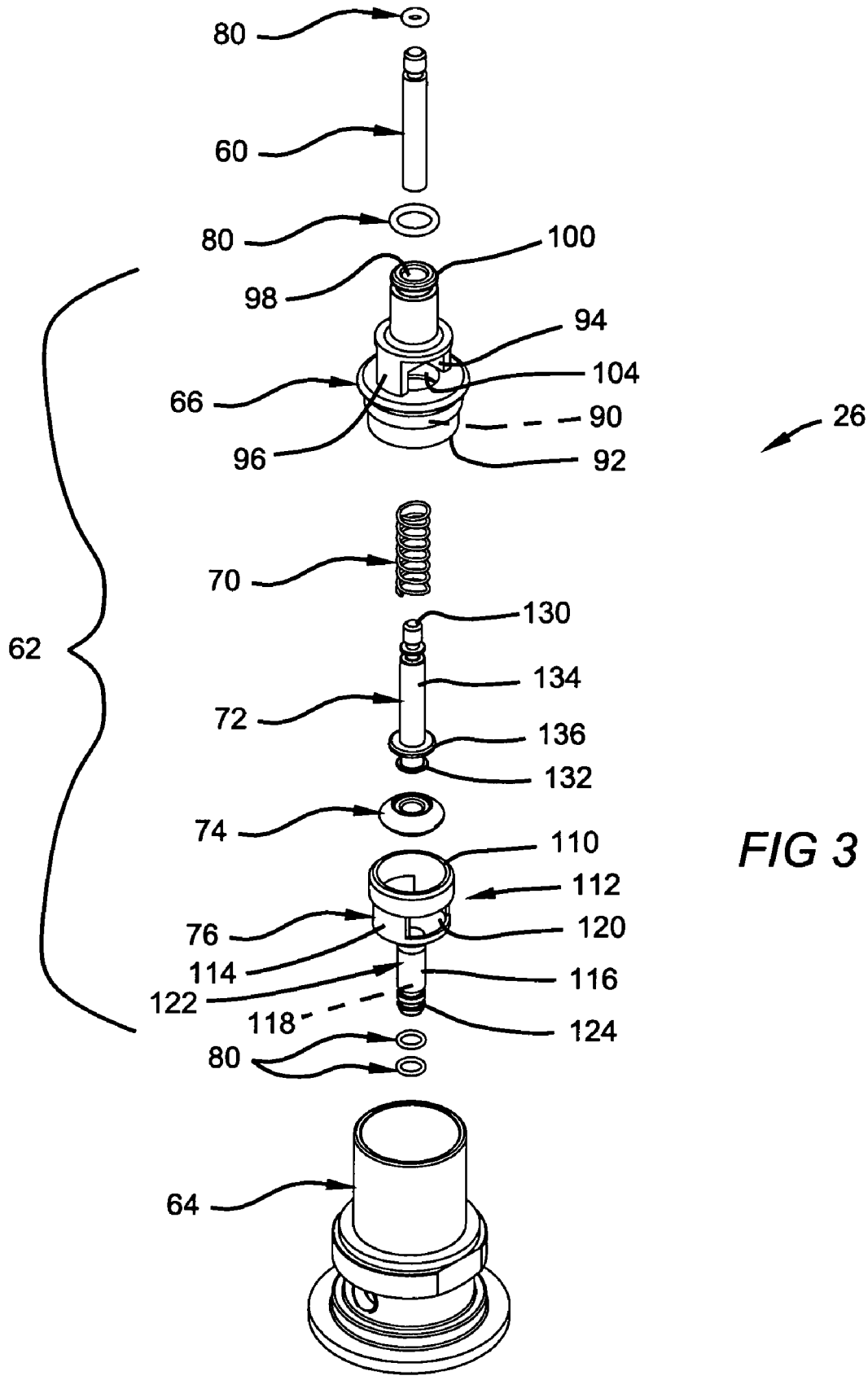
FIG. 3 is an exploded perspective view of the diverter assembly of the present invention.
Figure 4:
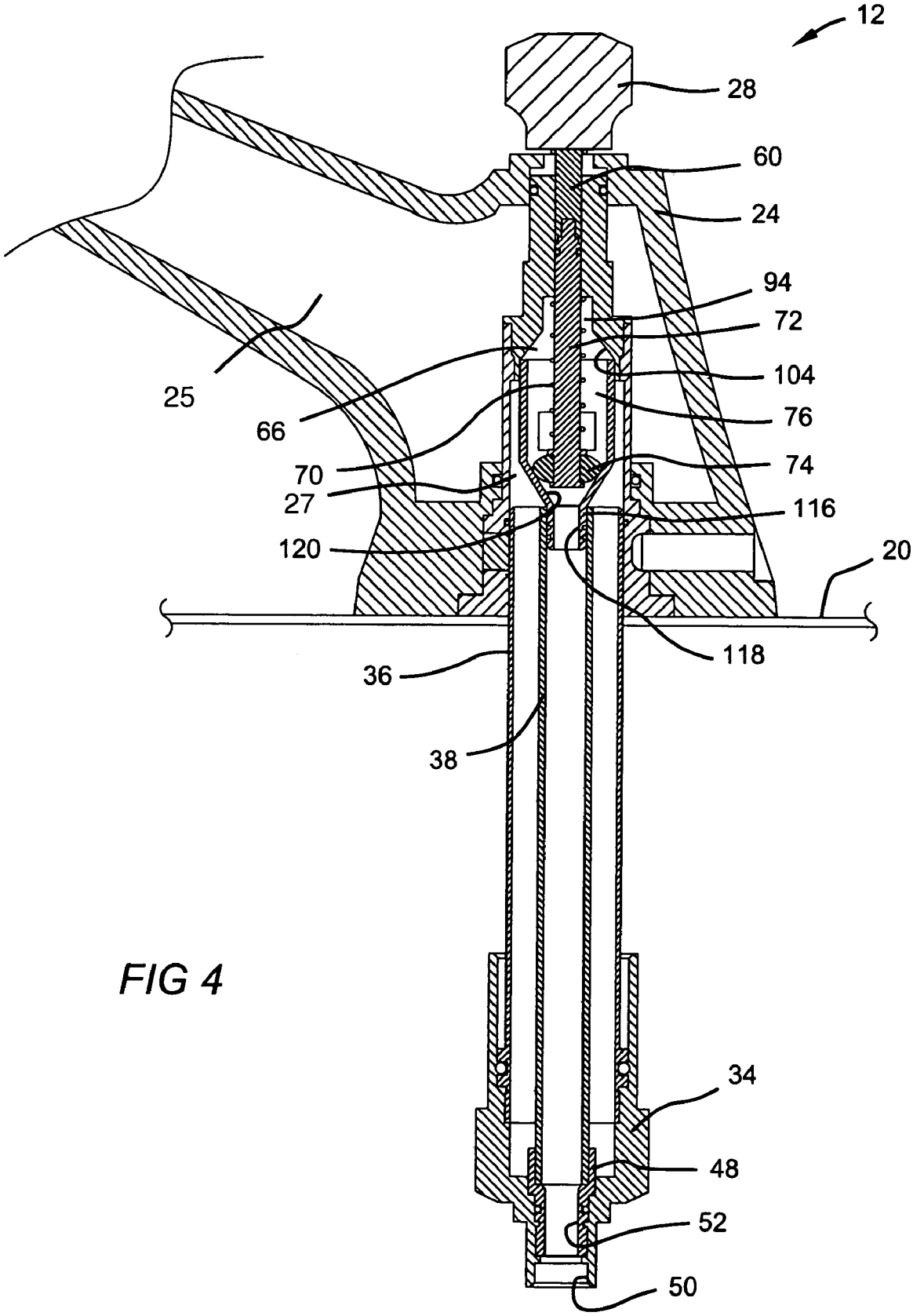
FIG. 4 is a cross-sectional view of the outlet assembly of FIG. 1 with the diverter assembly in a first position.

Referring now to FIGS. 3 and 4, a second valve assembly is disclosed. A second valve body, or diverter assembly 26, is located within spout 24 and operates to selectively direct fluid communication from inlet tube 36 to spout 24 or alternately to spray handle 18 via secondary outlet tube 38. Adapting and positioning the diverter assembly 26 in a location above the finished, or horizontal surface 20, such as in the interior chamber of spout 24, allows ease of access for service or repair. Diverter assembly 26 includes a rod 60, a sealing chamber assembly 62, and an anchor 64. Preferably, anchor 64 is adapted to slide over the feed tube 36 forming an inner chamber 27 disposed within the anchor 64. Sealing chamber assembly 62 includes a top, or upper coupling 66, a spring 70, a diverter valve or plunger 72, a seal 74, and a lower coupling 76. O-rings 80 of various diameters are utilized to provide a leak proof seal between components of roman tub faucet 10 as discussed below.

Top coupling 66 is preferably a component that defines a portion of a sealing chamber 90 at a lower end 92, a primary outlet 94 opening onto an exterior surface 96, a plunger guideway 98 intersecting the sealing chamber 90, and opening onto an upper end 100. The central portion of top coupling 66 is intersected by plunger guideway 98, primary outlet 94 and sealing chamber 90. The uppermost portion of sealing chamber 90 is defined by a frusto-conical surface 104 that opens onto primary outlet 94.

Lower coupling 76 is preferably adapted to releaseably couple at a top end 110 with top coupling 66, as best seen in FIG. 4, such that lower coupling 76 defines the lower portion of sealing chamber 90. Lower coupling 76 is a generally cylindrical component that includes an inlet 112 defined by an outer wall 114, a secondary outlet 116 with an axial passageway 118 thereth rough, and an inverted frusto-conical surface 120 defining the lower most portion of sealing chamber 90 such that axial passageway 118 is in fluid communication with inlet 112 and primary outlet 94 via sealing chamber 90. The exterior surface 122 of secondary outlet 116 preferably has two O-ring grooves 124. Secondary outlet 116 is adapted to removably couple to secondary tube 38 for ease of service and repair.

Plunger 72 includes a first end 130, a second end 132, a shaft 134, and a stop 136. Plunger 72 is adapted to slidingly retract into plunger guideway 98 by direct manual actuation. Plunger 72 is coupled to rod 60 at first end 130 to extend through the exterior of the faucet and to seal 74 at second end 132. Spring 70 is superposed on shaft 134 to bias plunger 72 towards lower coupling 76. Stop 136 limits the travel of spring 70 on shaft 134 and serves as a spring seat. Seal 74 is preferably constructed of a conventional polymer faucet sealing material with an annular cross section when viewed parallel to the axis of plunger 72. Seal 74 has a configuration which is complementary to surface 104, 120 to provide a fluid sealing interface therebetween.

Figure 5:
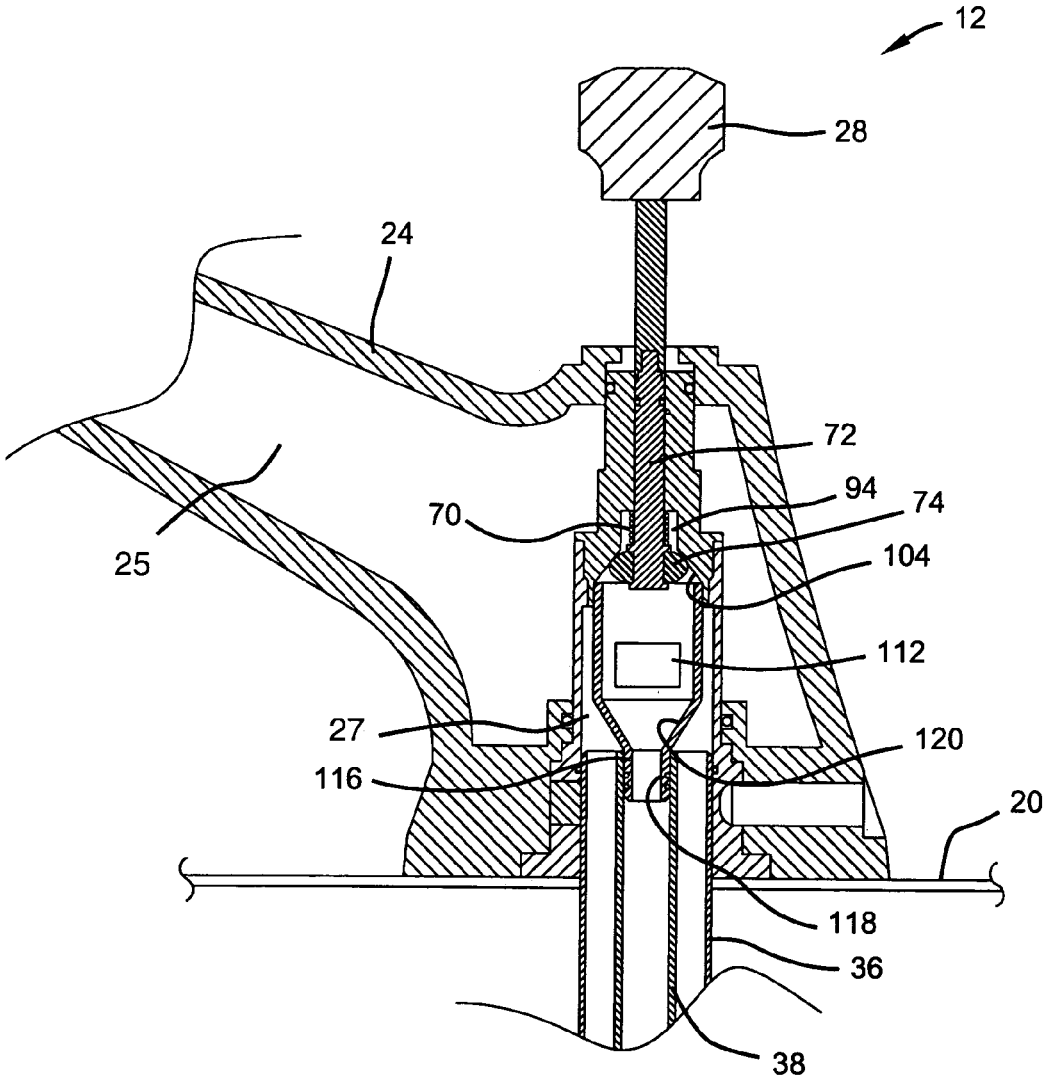
FIG. 5 is a cross-sectional view similar to FIG. 4 with the diverter assembly in a second position.

When diverter assembly 26 is fully assembled, spring 70, plunger 72, and seal 74 are located within sealing chamber 90. Seal 74 and plunger 72 are moveable between a first position (FIG. 4) in which seal 74 is in sealing contact with inverted frusto-conical surface 120 and a second position (FIG. 5) in which seal 74 is in sealing contact with frusto-conical surface 104. In this manner, seal 74, seals against frusto-conical surface 120 thereby interrupting fluid communication between sealing chamber 90 and secondary outlet 116 when in the first position. Seal 74 also seals against frusto-conical surface 104 when in the second position, thereby interrupting fluid communication between sealing chamber 90 and primary outlet 94. As best seen in FIG. 4, seal 74 preferably cannot interrupt fluid communication between sealing chamber 90 and inlet 112. Thus provided, water that enters inlet 112 can be diverted to either primary outlet 94 or secondary outlet 116 by moving plunger 72 and seal 74 between their first and second positions.

When outlet assembly 12 is fully assembled, inlet tube 36 is in fluid communication with inlet 112, and secondary outlet tube 38 is in fluid communication with secondary outlet 116. As best seen in FIG. 4, spout 24 is in fluid communication with primary outlet 94. Plunger 72 is coupled to rod 60 which is in turn coupled to knob 28. Thus provided, seal 74 can be moved between the first and second positions by raising and lowering knob 28.

In operation, water flows into body 34 from hot and cold valves 30, 32. The water mixes in body 34 and continues through inlet tube 36 and through inlet 112 of diverter assembly 26. When seal 74 is in the first position and fluid communication between sealing chamber 90 and secondary outlet 116 is interrupted, water flows from inlet 112 through sealing chamber 90 and through primary outlet 94 to spout 24 and into tub 22. When seal 74 is in the second position and fluid communication between sealing chamber 90 and primary outlet 94 is interrupted, water flows from inlet 112 through sealing chamber 90 and through secondary outlet 116 to secondary outlet tube 38 and into hand shower 18. Plunger 72 is biased in the second position in reach to water pressure within the sealing chamber assembly 62 which is exerted upon the sealing member 74.

It would be recognized by one of ordinary skill in the art that inlet tube 36 and diverter assembly 26 combine and are adapted to mix the hot and cold water such that water of an essentially consistent temperature can be supplied to either spout 24 or hand shower 18. The description of the invention is merely exemplary in nature and, thus, variations that do not depart from the gist of the invention are intended to be within the scope of the invention. Such variations are not to be regarded as a departure from the spirit and scope of the invention.

What is claimed is:

1. In combination, a faucet mounted on a finished surface of a roman tub, the faucet comprising:

a diverter assembly including:

a sealing chamber having an inlet, a primary outlet having fluid communication with a primary outlet spout; and a secondary outlet having fluid communication with a secondary outlet flow tube;

a manually actuated plunger at least partially disposed through said sealing chamber and extending through the exterior of the faucet, said plunger moveable between a first position and a second position by direct manual actuation;

a spring operable to bias said plunger toward said first position; and a sealing member located within said sealing chamber and coupled to said plunger for coordinated movement therewith, said sealing member adapted to seal said secondary outlet when said plunger is in said first position thereby permitting fluid communication through said sealing chamber between said inlet and said primary outlet, and said sealing member further adapted to seal said primary outlet when said plunger is in said second position thereby permitting said diverter assembly to coaxially divert fluid from an inlet tube to said secondary outlet, wherein said faucet is adapted to be mounted to said finished surface with at least a portion of said faucet extending below said finished surface and the primary outlet spout located above said finished surface, and said diverter mechanism is located within the faucet at a location above said finished surface.

2. The faucet of claim 1, wherein said plunger is biased in said second position in reaction to water pressure within said sealing chamber exerted upon said sealing member.

3. The faucet of claim 1, wherein the sealing member is adapted to seat on a frusto-conical surface.

4. A dual mode faucet assembly for mounting on a substantially horizontal surface, the faucet assembly comprising:

an outlet assembly having a spout, said spout mounted on the substantially horizontal surface;

a diverter assembly positioned in said spout, said diverter assembly including an upper coupling having a primary outlet, a lower coupling having a secondary outlet, and an anchor, wherein a lower end of said upper coupling is coupled to an upper end of said lower coupling forming a sealing chamber in selective fluid communication with said primary outlet and said secondary outlet, and said upper coupling is coupled to said anchor;

a manually actuated plunger partially disposed in said sealing chamber and extending through said upper coupling to the exterior of said outlet assembly, said plunger coupled to a sealing member for coordinated slidable movement therewith by direct manual actuation between a first position wherein said sealing member seals said secondary outlet and permits fluid communication with said primary outlet when said plunger is in said first position, and a second position wherein said sealing member seals said primary outlet and permits fluid communication with said secondary outlet when said plunger is in said second position;

a spring operable to bias said plunger toward said first position; an inlet tube in fluid communication with said anchor, said inlet tube operable to provide fluid from a fluid source located under the horizontal surface; and a secondary outlet tube disposed within said inlet tube, said secondary outlet tube coupled to said secondary outlet of said lower coupling.

5. The faucet assembly of claim 4, wherein said plunger is biased in said second position in reaction to water pressure within said sealing chamber exerted upon said sealing member.

6. The faucet assembly of claim 4, wherein said sealing member is adapted to seat on a frusto-conical surface.

7. The faucet assembly of claim 4, wherein said inlet tube is coaxial with said plunger.

8. A faucet assembly selectively operable in a spout mode and a hand spray mode, said faucet assembly comprising:

a spout supported on an upper surface of a faucet deck, said spout having an interior chamber located above said upper surface and in fluid communication with a spout outlet;

a first valve assembly located below said upper surface and including a supply valve operable to selectively enable fluid communication from a fluid source to a first valve body, said first valve body having a primary outlet and a secondary outlet;

a second valve assembly removably disposed within said interior chamber of said spout above said upper surface and including a second valve body having a discharge opening in fluid communication with said interior chamber and a manually actuated plunger disposed within said second valve body;

a feed tube extending between said first valve body and said second valve body, said feed tube having a primary fluid passageway providing fluid communication from said primary outlet to said second valve body and a concentric secondary fluid passageway within said primary fluid passageway providing fluid communication from said second valve body to said secondary outlet in said first valve body; and a hand sprayer supported on said upper surface of said faucet deck, said hand sprayer having a flexible hose coupled to said secondary outlet of said first valve body;

wherein said second valve assembly further comprises a spring member, and said manually actuated plunger extends through the exterior of the outlet assembly and is biased with said spring member in a first position to seal said secondary fluid passageway and permit fluid communication from said second valve body through said discharge opening and said interior chamber to said spout outlet such that said faucet assembly operates in a spout mode; and wherein said plunger is slidably adapted for direct manual movement to a second position to seal said discharge opening and permit fluid communication from said second valve body through said secondary fluid passageway and said secondary outlet of said first valve body to said spray outlet such that said faucet assembly operates in a spray mode.

9. The faucet assembly of claim 8 wherein said second valve assembly is coupled to said feed.

10. The faucet assembly of claim 9 wherein said secondary fluid passageway is generally parallel with and extends through said primary fluid passageway.

11. The faucet assembly of claim 8 wherein said second valve assembly comprises an anchor adapted to slide over said feed tube forming an inner chamber disposed within said anchor.

12. The faucet assembly of claim 11 wherein said plunger selectively seals said first axial passageway when in said first position and selectively seals said second axial passageway when in said second position.

13. A roman tub outlet assembly for mounting above a substantially horizontal surface, the outlet comprising:

an inlet tube;

a primary outlet spout;

a secondary outlet flow tube disposed within said inlet tube;

a diverter assembly configured to be located above the substantially horizontal surface and adapted to seal in both a first and second position;

a sealing chamber having an inlet, a primary outlet having fluid communication with said primary outlet spout, and a secondary outlet having an axial passageway removably coupled to and having fluid communication with said secondary outlet flow tube;

a manually actuated plunger at least partially disposed through said sealing chamber and extending through the exterior of the outlet assembly, said plunger moveable between said first position and said second position by direct manual actuation;

a spring member operable to bias said plunger toward said first position; and a sealing member located within said sealing chamber and coupled to said plunger for coordinated movement therewith, said sealing member adapted to seal said secondary outlet when said plunger is in said first position thereby permitting fluid communication through said sealing chamber between said inlet and said primary outlet, and said sealing member further adapted to seal said primary outlet when said plunger is in said second position thereby permitting fluid communication between said inlet and said secondary outlet.

14. The outlet assembly of claim 13, wherein said plunger is biased in said second position in reaction to water pressure within said sealing chamber exerted upon said sealing member.

15. The outlet assembly of claim 13, wherein said sealing member is adapted to seat on a frusto-conical surface.

16. The outlet assembly of claim 13, wherein said inlet tube is coaxial with said plunger.

17. The outlet assembly of claim 13, wherein said inlet tube is adapted to mix liquids from at least two sources.

18. The outlet assembly of claim 13, wherein said secondary outlet flow tube extends through said inlet tube.

19. The outlet assembly of claim 18, wherein said secondary outlet flow tube is coaxial with said inlet tube.

* * * * *

UNITED STATES PATENT AND TRADEMARK OFFICE

CERTIFICATE OF CORRECTION

PATENT NO. : 7,082,626 B2
APPLICATION NO. : 10/346875
DATED : August 1, 2006
INVENTOR(S) : Alston E. Williams et al.

It is certified that error appears in the above-identified patent and that said Letters Patent is hereby corrected as shown below:

Column 6,
Line 2, after "feed" insert -- tube --.

Signed and Sealed this

Third Day of April, 2007

JON W. DUDAS
*Director of the United States Patent and Trademark Office*